US010246975B2

(12) United States Patent
Spring et al.

(10) Patent No.: US 10,246,975 B2
(45) Date of Patent: Apr. 2, 2019

(54) SYSTEM AND METHOD FOR SHOCK MITIGATION

(71) Applicant: Schlumberger Technology Corporation, Sugar Land, TX (US)

(72) Inventors: Christian C. Spring, Houston, TX (US); Allan Goldberg, Alvin, TX (US); Sheryl Raezer, Pearland, TX (US); Christophe Rayssiguier, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 148 days.

(21) Appl. No.: 15/188,644

(22) Filed: Jun. 21, 2016

(65) Prior Publication Data

US 2017/0002633 A1 Jan. 5, 2017

Related U.S. Application Data

(60) Provisional application No. 62/187,013, filed on Jun. 30, 2015.

(51) Int. Cl.

| | |
|---|---|
| ***E21B 43/116*** | (2006.01) |
| ***E21B 47/14*** | (2006.01) |
| ***E21B 43/119*** | (2006.01) |
| ***E21B 17/07*** | (2006.01) |

(52) U.S. Cl.

CPC ..... *E21B 43/1195* (2013.01); *E21B 17/07* (2013.01); *E21B 43/116* (2013.01); *E21B 47/14* (2013.01)

(58) Field of Classification Search

CPC ..... E21B 29/02; E21B 43/116; E21B 43/117; E21B 47/01; E21B 47/011; E21B 47/12; E21B 47/14

USPC ..... 166/63; 102/321; 89/1.15

See application file for complete search history.

(56) References Cited

U.S. PATENT DOCUMENTS

| | | | | |
|---|---|---|---|---|
| 4,693,317 | A | 9/1987 | Edwards et al. | |
| 4,817,710 | A * | 4/1989 | Edwards | E21B 17/07 166/113 |
| 6,378,607 | B1 * | 4/2002 | Ryan | E21B 43/119 166/255.1 |
| 8,136,608 | B2 | 3/2012 | Goodman | |
| 8,276,656 | B2 | 10/2012 | Goodman | |

(Continued)

FOREIGN PATENT DOCUMENTS

EP 2597250 A1 5/2013

OTHER PUBLICATIONS

The extended european search report issued in the related EP Application 16177218.1, dated Nov. 29, 2016 (7 pages).

(Continued)

*Primary Examiner* — Kenneth L Thompson

(57) ABSTRACT

A technique facilitates mitigation of shock loads. Subterranean communication systems may comprise components susceptible to various shock loads. A shock mitigation system is physically coupled with the subterranean communication system to mitigate such shock loads. The shock mitigation system comprises components selected to enable reduction of various effects of shock loads, e.g. shock loads resulting from perforating procedures, which could otherwise be detrimental to continued operation of the subterranean communication system.

18 Claims, 7 Drawing Sheets

(56) References Cited

U.S. PATENT DOCUMENTS

| | | | | |
|---|---|---|---|---|
| 2002/0185275 | A1* | 12/2002 | Yang | E21B 17/1057 166/297 |
| 2009/0151589 | A1* | 6/2009 | Henderson | E21B 17/07 102/333 |
| 2012/0152614 | A1 | 6/2012 | Rodgers et al. | |
| 2012/0155219 | A1* | 6/2012 | Alteirac | E21B 43/11857 367/81 |
| 2013/0048376 | A1* | 2/2013 | Rodgers | E21B 43/1195 175/4.6 |
| 2015/0090452 | A1 | 4/2015 | Sangare et al. | |
| 2015/0252669 | A1* | 9/2015 | Fair | E21B 47/06 166/250.02 |

OTHER PUBLICATIONS

The Office Action issued in the related EP Application 16177218.1, dated Feb. 27, 2018 (5 pages).

* cited by examiner

SYSTEM AND METHOD FOR SHOCK MITIGATION

CROSS-REFERENCE TO RELATED APPLICATIONS

This application claims the benefit of U.S. Provisional Application No. 62/187,013, filed Jun. 30, 2015.

BACKGROUND

Hydrocarbon fluids such as oil and natural gas are obtained from a subterranean geologic formation, referred to as a reservoir, by drilling a wellbore that penetrates the hydrocarbon-bearing formation. Once a wellbore is drilled, the surrounding formation may be perforated via firing of a perforating gun assembly deployed downhole on a tool string. The tool string may comprise a telemetry system employing telemetry equipment to transmit telemetry signals downhole and/or uphole along the tool string. However, the shock loads resulting from firing of the perforating gun assembly can damage or destroy components of the telemetry system.

SUMMARY

In general, a methodology and system are provided which enable mitigation of shock loads. According to an embodiment, a subterranean communication system may comprise components susceptible to shock loads. A shock mitigation system is physically coupled with the subterranean communication system to mitigate such shock loads. The shock mitigation system comprises components which reduce various effects of shock loads, e.g. shock loads resulting from perforating procedures, which could otherwise be detrimental to continued operation of the subterranean communication system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
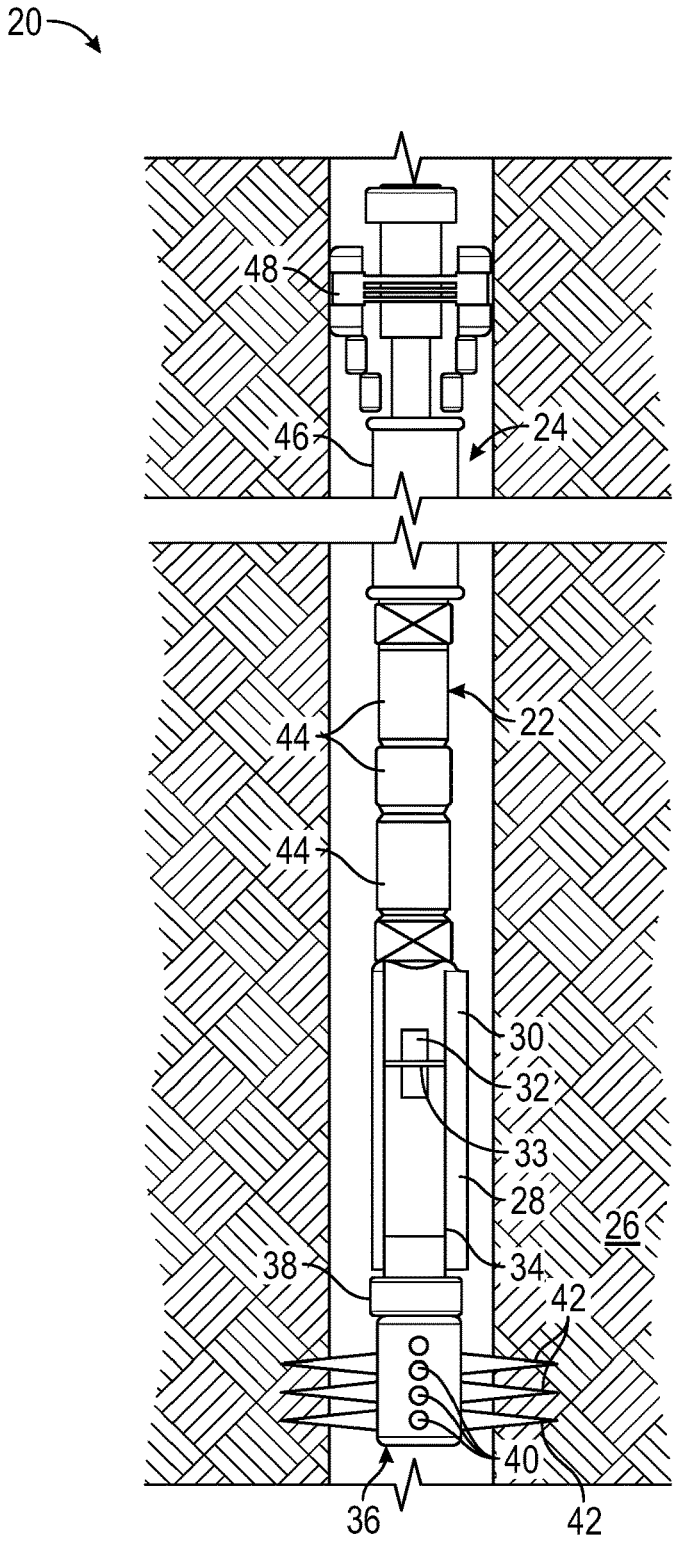
FIG. 1 is a schematic illustration of an example of a well system utilizing a shock mitigation system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate mitigation of shock loads. According to an embodiment, a subterranean communication system, e.g. an acoustical telemetry system, may comprise components susceptible to shock loads. A shock mitigation system is physically coupled with the subterranean communication system to mitigate such shock loads. In various perforating operations, for example, large shock loads may be induced along a tool string upon firing of a perforating gun assembly. The shock mitigation system comprises components which reduce various effects of these shock loads so as to facilitate continued operation of the subterranean communication system.

In various embodiments, acoustical telemetry systems are used to acoustically transmit signals along a tool string deployed in a wellbore. The acoustical telemetry system may be used to generate and/or receive signals in the form of acoustic waves which carry information uphole along the tool string or carry control signals downhole along the tool string. These types of acoustic and other communication systems are useful in subterranean Earth borehole type applications in various industries, such as the gas and oil industry.

During development of gas and oil wells, a borehole is drilled and cased with steel tubing and cement/concrete. To enhance access to a pay zone of a surrounding formation, holes are created in the formation of interest by firing perforating gun assemblies. During detonation of shaped charges of the perforating gun assembly, pyrotechnic shock loads and hydrodynamic shock loads are generated. Acoustic modems/transducers and/or other components of the subterranean communication system can be damaged or rendered inoperable by such shock loads. Accordingly, the shock mitigation system is combined with the communication system, e.g. acoustical communication system, to protect components of the communication system from potentially detrimental shock loads.

In applications utilizing an acoustical communication system, the shock mitigation system may be coupled with a movable acoustical member of the communication system in a manner which allows physical movement of the acoustical member while absorbing shock loads. In some acoustical communication systems, for example, acoustical signals are transmitted via an acoustical rod member and excess movement of the acoustical rod member can damage the communication system. However, the shock mitigation system may combine various shock mitigation components with the acoustical rod member (or other communication system member susceptible to shock load damage) to reduce the effects of shock loads.

According to an embodiment, the shock mitigation system may be physically coupled to the acoustical rod member by, for example, a clutch. In some applications, the clutch effectively couples the acoustical rod member with a corresponding "modem" or other component for outputting or receiving transmitted acoustical signals. During sufficient shock loading, e.g. perforating shock loading, the rod member may slide inside the clutch at a predetermined rate. As the rod slides, an additional shock absorber/mitigator absorbs excess energy from the shock load, e.g. from the shock resulting from firing of the perforating gun assembly. The friction provided by the clutch also helps absorb shock energy.

After the shock energy is absorbed, the rod member can move partially or fully back to its original position due to the biasing force applied via the shock absorber/mitigator components. However, the clutch still sufficiently clamps the acoustical rod member so the acoustical rod member remains acoustically coupled as desired within the acoustical communication system. For example, the acoustical rod member remains acoustically coupled with the "modem" or other acoustic transmission component. After the shock loading is absorbed and mitigated, the communication system thus recovers and is able to communicate acoustic signals while also being able to absorb subsequent shock loads.

Referring generally to FIG. 1, an embodiment of a well system 20 is illustrated as comprising a tool string 22 deployed downhole into a wellbore 24 drilled into or through a formation 26. In this example, the tool string 22 comprises a communication system 28, e.g. an acoustical communication system, coupled with a shock mitigation system 30. In applications utilizing acoustic communication, the acoustical communication system 28 may comprise a wireless telemetry system for outputting and/or receiving acoustic signals along the tool string 22 via an acoustical member 32. The acoustical member 32 may be an acoustical rod member and is coupled with an appropriate acoustical device 33, e.g. a receiver or transceiver device which may be in the form of an acoustical signal transducer often referred to as a modem.

The acoustical modem 33 is a device which converts computer-based telemetry signals into acoustic signals (or vice versa). The acoustical modem 33 is coupled with acoustical member/rod 32 and acoustic signals flow through the acoustical member/rod 32. Acoustical member 32 also is connected to a bulkhead or other suitable structure via an acoustical clutch, embodiments of which are described in greater detail below. An example of an acoustical communication system is the MuZIC™ acoustical telemetry system available from Schlumberger Corporation although a variety of other communication systems 28 may be used in many types of subterranean operations.

As further illustrated in FIG. 1, the acoustic communication system 28 may be coupled with a firing device 34 which, in turn, is coupled with a perforating gun assembly 36. In the example illustrated, the perforating gun assembly 36 comprises a safety spacer 38 at its upper end. Additionally, the perforating gun assembly 36 comprises a plurality of shaped charges 40 which may be selectively detonated via firing device 34 in response to control signals relayed through acoustical communication system 28. When the perforating gun assembly 36 is fired, the shaped charges 40 are detonated and create perforations 42 which extend outwardly into the surrounding formation 26. The force of the detonation sends shock loads along the tool string 22 which can potentially damage components of communication system 28 without the shock absorption provided by shock mitigation system 30.

Depending on the specifics of a given application, the tool string 22 may comprise a variety of other equipment 44, e.g. flow isolation valves, crossovers, pup joints, and/or other equipment. In some applications, the tool string 22 may comprise drill pipe 46 and a packer or packers 48 which may be used to selectively isolate portions of the wellbore 24. Various components and arrangements of components may be used along the tool string 22 in combination with communication system 28 and shock mitigation system 30. In some applications, the shock mitigation system 30 (or an additional shock mitigation system 30) may be used to mitigate shock loads with respect to other components along the tool string 22.

Figure 2:
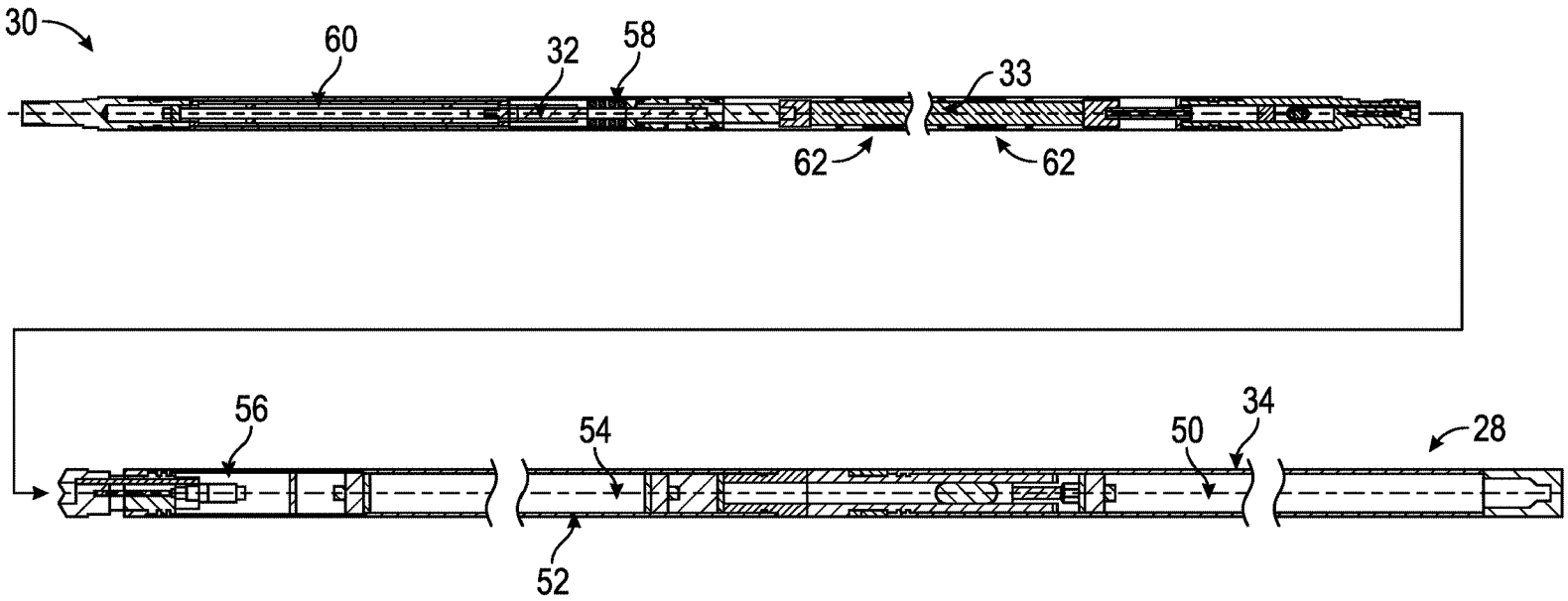
FIG. 2 is a schematic illustration of an example of a shock mitigation system coupled with a communication system in a tool string, according to an embodiment of the disclosure.

Referring generally to FIG. 2, an embodiment of shock mitigation system 30 combined with an embodiment of acoustic communication system 28 is illustrated. In this example, the acoustic communication system 28 may comprise a variety of components including firing device 34 and associated electronics 50. The acoustic communication system 28 may further comprise a pressure housing 52 and an internal battery 54 to provide electrical power for the communication system 28, including electrical power for the firing device electronics 50. Additionally, communication system 28 comprises acoustical member 32 engaged with corresponding acoustical modem 33 (or other suitable device). The acoustical modem 33 may work in cooperation with a pressure transducer 56. However, other and/or additional components may be incorporated into the acoustical communication system 28 according to the parameters of a given application.

Figure 3:
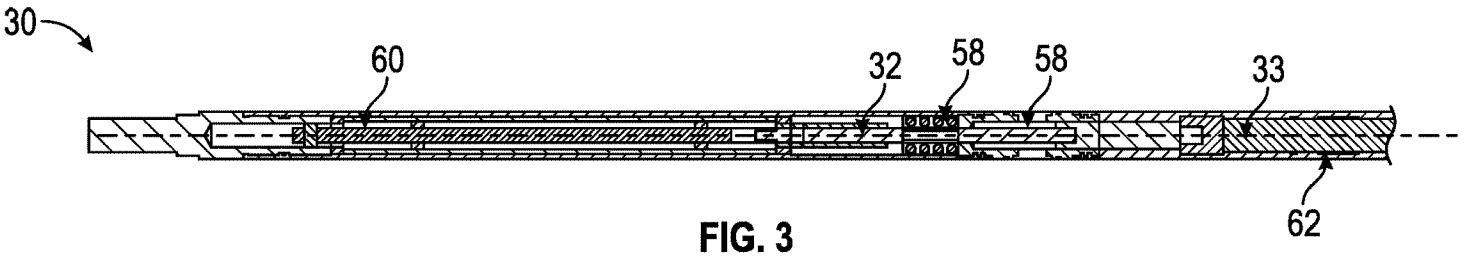
FIG. 3 is a schematic illustration of a portion of the system illustrated in FIG. 2, according to an embodiment of the disclosure.

Similarly, the shock mitigation system 30 may comprise a variety of components. With additional reference to FIG. 3, an embodiment of the shock mitigation system 30 comprises an acoustical clutch 58 which effectively clamps against acoustical member 32 so as to absorb shock loading by allowing controlled movement of acoustical member 32. In some applications, the mitigation system 30 may comprise additional shock mitigators, such as at least one axial shock mitigator 60 and at least one lateral, e.g. radial, shock mitigator 62.

The acoustical clutch 58 serves as a clamping device which allows acoustical energy, during normal use, to be coupled between the acoustical member, e.g. rod, 32 and an associated bulkhead or other suitable structure, e.g. a bulkhead of the modem 33 as described below. During high shock loading, e.g. during detonation of perforating gun assembly 36, the clamping force provided by acoustical clutch 58 against rod 32 may be exceeded. This allows the acoustical rod 32 (and connected modem 33) to move in an axial direction but while limiting acceleration and dissipating energy via the resistance provided by clutch 58. For single uses, the acoustical clutch 58 may be a manually resettable clutch. For example, the clutch 58 may be constructed to absorb the full perforating shock energy and then manually reset when the tool is redressed. For multiple uses and auto resetting, e.g. automatic re-centering, of the clutch 58, a return spring mechanism may be employed to provide the automatic resetting.

In some embodiments, the acoustical clutch 58 works in cooperation with an axial shock mitigator 60 which may be used to provide spring bias for the automatic resetting. According to an embodiment, the axial shock mitigator 60 is a shock absorber constructed to absorb excess energy not absorbed by clutch 58. Depending on the construction of the axial shock mitigator 60, the shock absorber may be used to return the acoustic modem 33 to a neutral position after the shock event, e.g. firing of perforating gun assembly 36. Examples of shock absorbers used in axial shock mitigator 60 include hydraulic shock absorbers, fiction springs, Belleville disc springs with dampers, rubber crush elements, or one time crush elements. Crush elements for one time use may be constructed from materials such as aluminum tubing, copper tubing, plastic tubing, and/or other suitable materials that can absorb excess energy. The crush elements also can be constructed in other forms and can be, for example, machined or molded.

Similarly, the acoustical clutch 58 may be used in cooperation with a lateral shock mitigator 62. According to an embodiment, the lateral shock mitigator 62 may be a radially mounted elastic shock absorbing material positioned around the acoustical member 32 and/or modem 33. By way of example, the elastic material may comprise a polymer and may include Teflon™, silicon rubber, Viton™ rubber, and/or other suitable materials.

Figure 4:
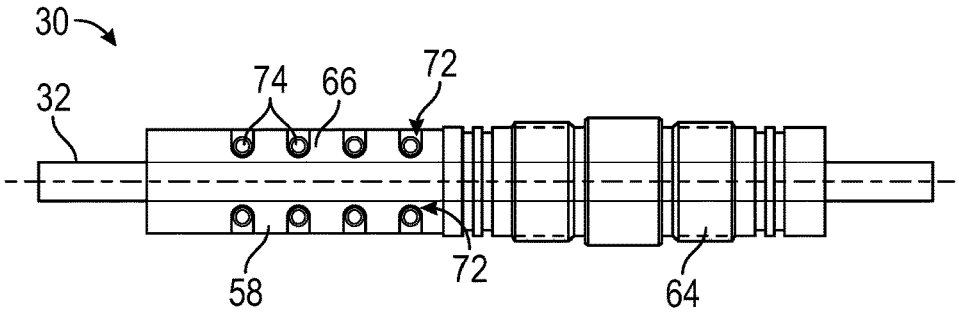
FIG. 4 is a side view of an example of a clutch which may be utilized in a shock mitigation system, according to an embodiment of the disclosure.
Figure 5:
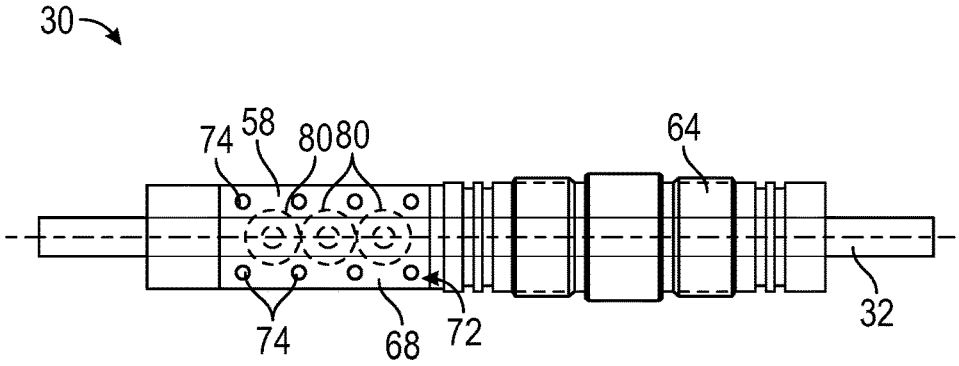
FIG. 5 is a side view of an example of a clutch similar to that of FIG. 4 but from an opposite side, according to an embodiment of the disclosure.
Figure 6:
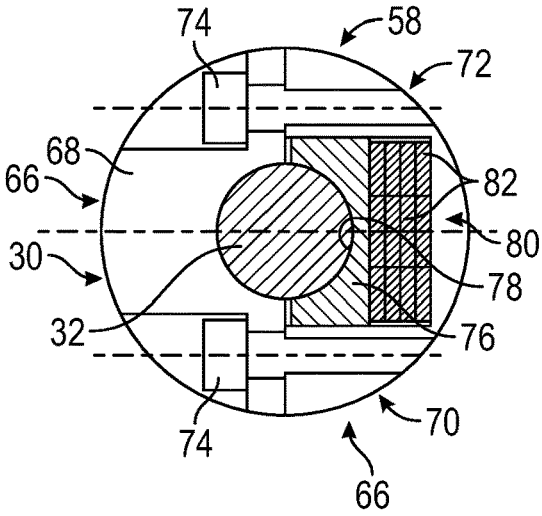
FIG. 6 is a cross-sectional view of an example of a clutch which may be utilized in a shock mitigation system, according to an embodiment of the disclosure.

Referring generally to FIGS. 4-6, an embodiment of acoustical clutch 58 is illustrated as clamped against acoustical rod member 32. In this example, the acoustical clutch 58 also is coupled with a bulkhead 64 of modem 33 to form a movable coupling between acoustical rod member 32 and bulkhead 64 of modem 33. By way of example, the acoustical clutch 58 may comprise cooperating clutch components 66, as illustrated in FIGS. 4 and 5. By way of example, the cooperating clutch components 66 may comprise a machined bulkhead portion 68 extending from bulkhead 64 and a cover 70, as illustrated in the embodiment of FIG. 6. The clutch components 66 may be releasably coupled together by a suitable fastener 72, such as a plurality of clamping screws 74.

Additionally, a saddle 76 or a plurality of saddles 76 may be clamped between clutch components 66 in a manner which forces the saddle(s) 76 against acoustical rod member 32 (see FIG. 6). In the example illustrated, each saddle 76 of acoustical clutch 58 comprises a profiled section 78 having a profile selected for lateral engagement with acoustical rod member 32. The saddle(s) 76 may be biased against acoustical rod member 32 via an appropriate biasing member 80, such as a spring member. In the example illustrated in FIG. 6, the biasing member 80 comprises a plurality of Belleville spring washers 82 arranged in stacks and held against the corresponding saddle 76 by cover 70. The number and type of Belleville spring washers 82 are selected to apply the desired amount of clamping force, e.g. friction, acting against acoustical rod member 32. The cover 70 may be secured against the corresponding clutch component 66, e.g. machined bulkhead portion 68, via clamping screws 74.

It should be noted that various components, configurations of components, and/or materials may be used in the construction of acoustical clutch 58. For example, the Belleville spring washers 82 provide a relatively high force in a small volume. However, biasing member 80 also may be formed with other springs, e.g. coil springs or wave springs, which may be suitable in various applications. Additionally, the biasing member 80 may be formed from a variety of suitable spring materials, such as steel, stainless steel, beryllium copper, beryllium nickel, or other suitable materials or combinations of materials. As illustrated in FIG. 5, the biasing member 80 may be arranged in three spring sets but other numbers of spring sets also may be used according to the parameters of a given application.

Similarly, the saddle 76 may be constructed from a variety of materials and in a variety of configurations. Generally, the material is selected to allow motion of the acoustical rod member 32 relative to saddle 76 while still being able to support the forces generated by biasing member 80. In some applications, saddle 76 may be constructed from the same type of material used to construct machined bulkhead portion 68. The cover 70 also may be constructed from a variety of suitable materials, including the same type of material used to form the machined bulkhead portion 68.

In the example illustrated, the machined bulkhead portion 68 extends from bulkhead 64 and bulkhead 64 serves as a pressure bulkhead into which the acoustical clutch 58 is integrated. The material of bulkhead 64 is selected according to the pressures, temperatures, fluids, and/or other environmental factors associated with a given application. The material and structure of the acoustical rod 32 is selected so as to support the mass of modem 33 while also being able to transfer acoustical energy into the bulkhead 64 through the acoustical clutch 58. In many applications, the acoustical rod member 32 may be formed from aluminum bronze but other materials, e.g. steels, stainless steels, brasses, also may be used in a variety of applications.

Figure 7:
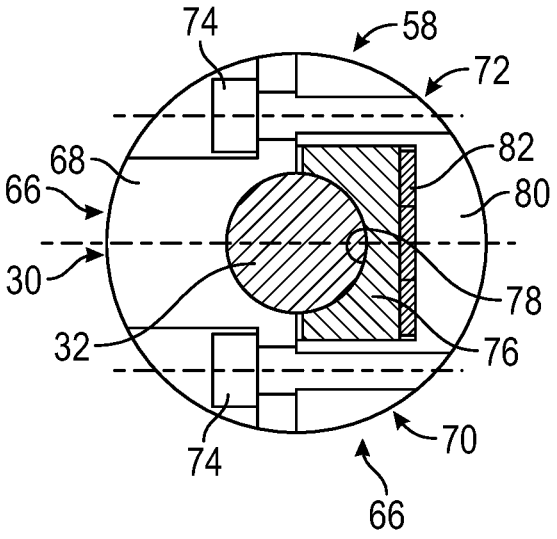
FIG. 7 is a cross-sectional view of another example of a clutch which may be utilized in a shock mitigation system, according to an embodiment of the disclosure.
Figure 8:
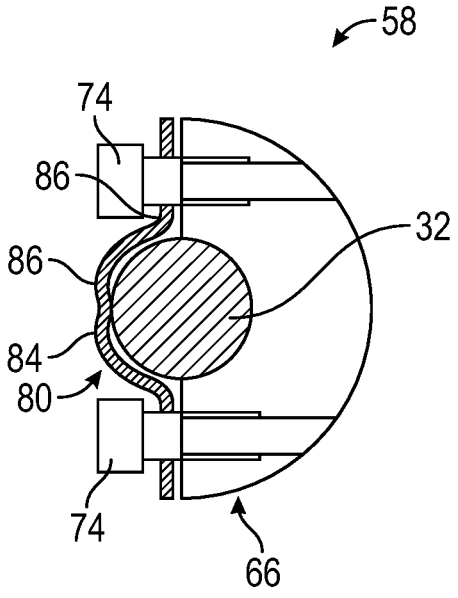
FIG. 8 is a cross-sectional view of another example of a clutch which may be utilized in a shock mitigation system, according to an embodiment of the disclosure.

Referring generally to FIGS. 7-10, other embodiments of acoustical clutch 58 are illustrated. In the embodiment of FIG. 7, for example, the biasing member 80 is formed with a single Belleville spring washer 82 instead of a stack of the washers 82 as in the previous embodiment. In some applications, the biasing member 80 may be in the form of a stamped sheet metal clamp 84, as illustrated in FIG. 8. The sheet metal clamp 84 is constructed to apply sufficient lateral force to the acoustical rod 32 so as to create the desired friction. In some applications, the sheet metal clamp 84 may include compliance bends 86 which allow for temperature compensation and machining tolerance stack-up considerations.

Figure 9:
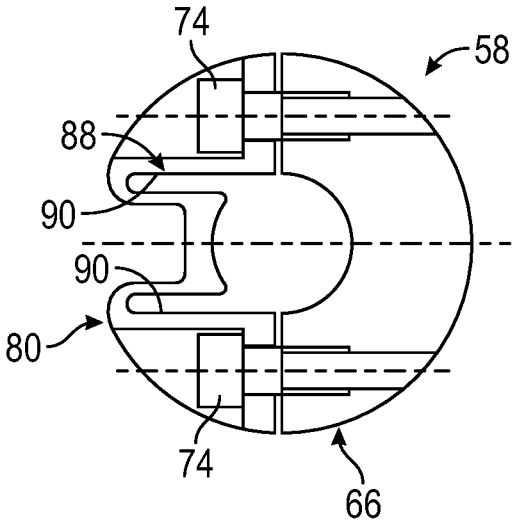
FIG. 9 is a cross-sectional view of another example of a clutch which may be utilized in a shock mitigation system, according to an embodiment of the disclosure.
Figure 10:
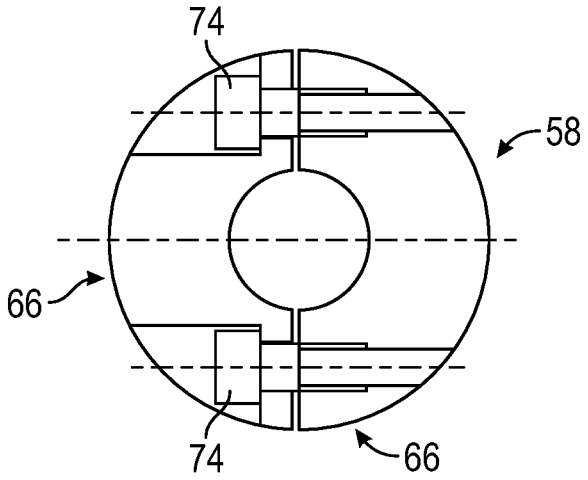
FIG. 10 is a cross-sectional view of another example of a clutch which may be utilized in a shock mitigation system, according to an embodiment of the disclosure.
Figure 11:
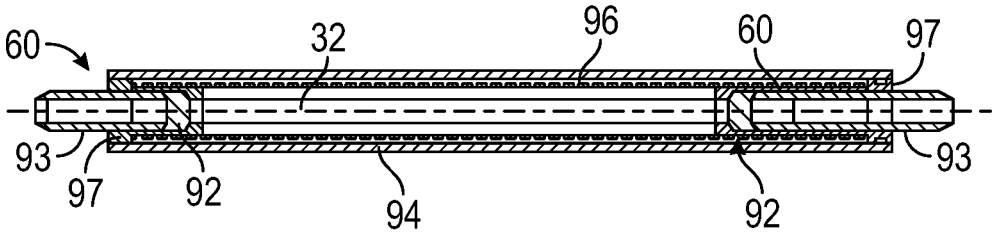
FIG. 11 is a schematic illustration of an example of a shock mitigation component which may be utilized in a shock mitigation system, according to an embodiment of the disclosure.

The biasing member 80 also may comprise a machined clamp 88, as illustrated in FIG. 9. The machined clamp 88 may comprise compliance stress relief cuts 90 which also are constructed for temperature compensation and machining tolerance stack-up considerations. In some applications, however, the biasing member 80 may effectively comprise the clamping screws 74 as illustrated in FIG. 10. In this type of arrangement, the cooperating clutch components 66 (or a separate inserted component) simply act against the acoustical rod 32 upon tightening of the clamping screws 74. The torque applied to the clamping screws 74 controls the clamping force applied to the acoustical rod 32.

Referring generally to FIGS. 11-15, various embodiments of the shock mitigators, e.g. axial shock mitigator 60, are illustrated. In the embodiment illustrated in FIG. 11, for example, axial shock mitigator 60 is constructed with elastomeric shock absorbing element 92, e.g. two shock absorbing elements 92, coupled to acoustical rod member 32 by a coupling bushing 93, e.g. two coupling bushings 93, within a shock mitigation system housing 94. The elastomeric shock absorbing elements 92 may be constructed from rubber or from another suitable shock absorbing material. Additionally, the elastomeric shock absorbing elements 92 may be coupled between acoustical rod 32 and surrounding friction spring elements 96 by a piston cup 97, e.g. two piston cups 97. The surrounding friction spring elements 96 may be disposed along the interior of housing 94. By way of example, the friction spring elements 96 may comprise elastic elements such as spring steel, but they also may comprise a variety of other materials.

The friction spring elements 96 work in cooperation with shock absorbing elements 92 to provide a desired resistance to motion of rod 32. Effectively, the shock load absorbing characteristics of shock absorbing elements 92 and friction spring elements 96 cooperate to dissipate axial shock loads acting through rod 32 while still maintaining an acoustical connection between acoustical rod 32, acoustical clutch 58, and bulkhead 64/modem 33 to enable transmission of acoustic signals. To at least some extent, the friction spring elements 96 also may dissipate lateral, e.g. radial, shock loads. In some embodiments, the friction spring elements 96 may be used as the primary shock absorbing elements while the shock absorbing elements 92 effectively provide bumpers which serve as secondary shock absorbing elements to dampen high frequency vibration.

Figure 12:
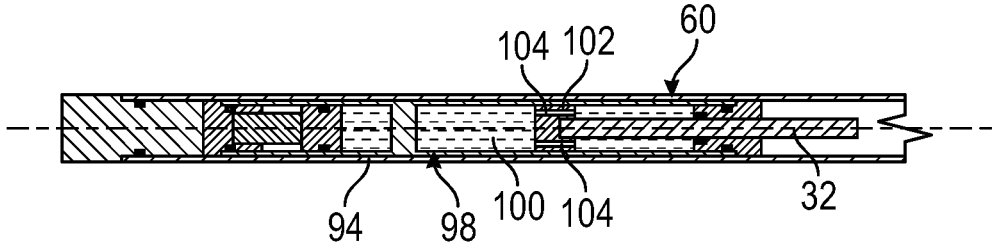
FIG. 12 is a schematic illustration of another example of a shock mitigation component which may be utilized in a shock mitigation system, according to an embodiment of the disclosure.

Another embodiment of axial shock mitigator 60 is illustrated in FIG. 12. In this embodiment, the axial shock mitigator 60 comprises a hydraulic shock absorber 98 which may include a hydraulic fluid 100. A piston 102 is coupled with acoustical rod 32 and moves through hydraulic fluid 100 when acoustical rod 32 is shifted by, for example, shock loads resulting from firing of perforating gun assembly 36. The piston 102 comprises flow passages 104 which enable a limited amount of the hydraulic fluid 100 to pass along the flow passages 104 when piston 102 is moved along the surrounding system housing 94, thus absorbing and mitigating shock loads. The piston 102 also may be frictionally engaged with the surrounding cylinder wall of housing 94 so as to retain an acoustical coupling.

Figure 13:
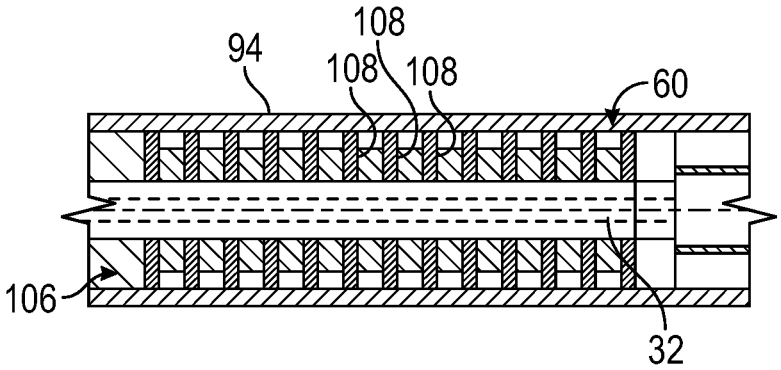
FIG. 13 is a schematic illustration of another example of a shock mitigation component which may be utilized in a shock mitigation system, according to an embodiment of the disclosure.

Similar resistance to movement of acoustical rod 32 and corresponding mitigation of shock loads may be achieved by frictionally engaging the acoustical rod 32 with a rubber shock absorber 106, as illustrated in FIG. 13. In this embodiment, shock loading is absorbed and mitigated by a plurality of rubber components 108 disposed between acoustical rod 32 and the surrounding system housing 94 so as to provide frictional resistance to movement of acoustical rod 32 while still maintaining the acoustical coupling.

Figure 14:
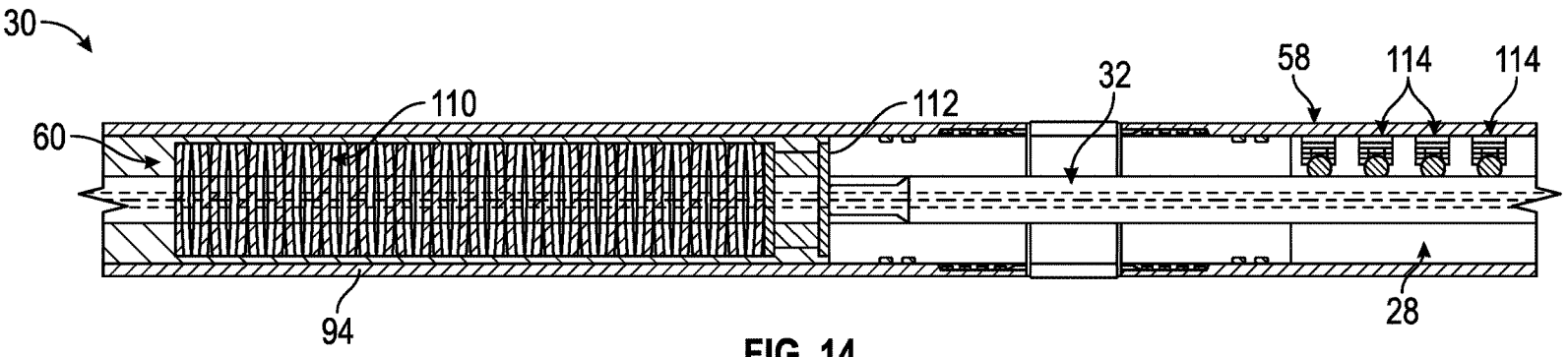
FIG. 14 is a schematic illustration of another example of a shock mitigation component which may be utilized in a shock mitigation system, according to an embodiment of the disclosure.
Figure 15:
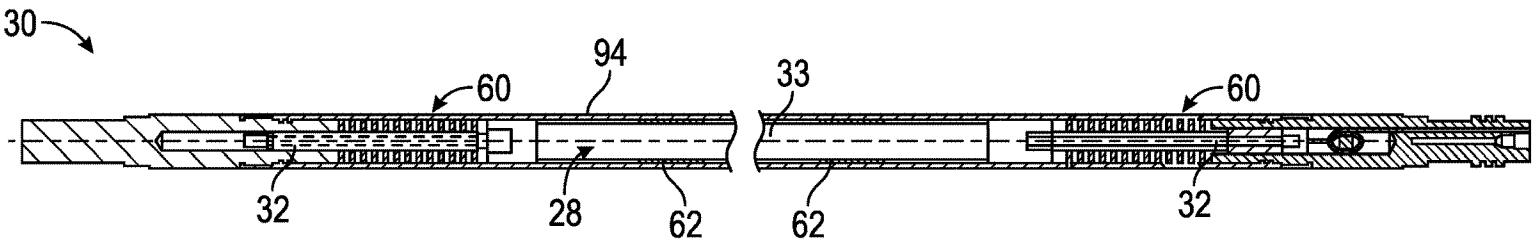
FIG. 15 is a schematic illustration of another example of a shock mitigation component which may be utilized in a shock mitigation system, according to an embodiment of the disclosure.

Referring generally to FIGS. 14 and 15, additional embodiments of the shock mitigation system 30 are illustrated. In the embodiment illustrated in FIG. 14, the axial shock mitigator 60 may comprise a stack of Belleville disc springs 110 which absorb shock loads while compressing sufficiently to allow sufficient linear movement of acoustical rod member 32 for transfer of acoustical signals. By way of example, the rod 32 may be coupled with a load transfer member 112 which acts against the stack of Belleville disc brings 110 to absorb shock loads while still allowing acoustical movement of the rod 32. It should be noted that acoustical clutch 58 also may have a variety of configurations, including a plurality of spring-loaded ball rollers 114 positioned to act laterally against the acoustical rod 32, as illustrated in FIG. 14.

In the embodiment illustrated in FIG. 15, a plurality of the axial shock mitigators 60 is employed. Depending on the application, various types of the axial shock mitigators 60 may be used at various positions along acoustical rod 32 and/or acoustical modem 33. In the example illustrated, an axial shock mitigator 60 is positioned at each end of the acoustical modem 33 to absorb shock loading experienced by modem 33 while also allowing the acoustical modem 33 to return to a neutral position for subsequent use in transmitting acoustic signals.

The acoustical clutch 58, axial shock mitigator(s) 60, and lateral shock mitigator(s) 62 may be used individually or in various combinations and configurations to establish the desired shock mitigation system 30. A specific configuration may be selected according to the parameters of a given application. The shock mitigation system 30 is constructed to protect the acoustical modem 33 and/or other communication system components during substantial shock loading, such as that experienced during firing of the perforating gun assembly 36. In embodiments utilizing modem 33, the shock mitigation system 30 isolates the acoustical modem 33 during, for example, perforation procedures while enabling retention of an operable acoustical coupling following the perforating procedure.

In various embodiments described above, the acoustical clamp 58 allows acoustical energy to be transmitted and received to and from the modem 33 through the bulkhead 64 and acoustical rod 32. However the acoustical clamp 58 is readily used in cooperation with shock mitigator 60 and/or shock mitigator 62 to absorb detrimental shock loads so as to enable continued transfer of acoustical energy after the communication system 28 experiences a high shock environment.

The modem 33 (and/or other communication system components) may thus be exposed to the acceleration resulting from shock loading, but the shock absorbing capability of the clutch 58 with corresponding shock mitigators 60/62 moderates the shock experienced by the modem 33 and/or other protected components. Examples of other components that may be protected by shock mitigation system 30 include repeaters located below packer 48. In perforating applications, the modem 33 or other susceptible components are isolated from the shocks that result from firing of the perforating gun assembly 36 while effectively enabling mechanical reconnection of the acoustical communication system components after perforation so that acoustical communications can continue.

Depending on the application, the shock mitigation system 30 may be used with several types of well equipment or non-well related equipment for isolating components from excessive shock loading while enabling retention of a mechanical linkage between components. However, features of the shock mitigation system 30 also may be used to protect a variety of standalone components or linked components in communication systems and other susceptible systems. In well applications, the shock mitigation system may be used to protect not simply acoustical modems but also a variety of other telemetry system components. Various configurations and arrangements of the components 58, 60, 62 used in shock mitigation system 30 can be assembled to protect many types of sensitive components that may be subjected to short-term but high shock loading environments.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tool string deployed in a wellbore, the tool string having:

a perforating gun assembly;

an acoustical communication system; and a shock mitigation system mounted along the tool string to mitigate shocks to the acoustical communication system resulting from firing of the perforating gun assembly, wherein the shock mitigation system comprises an acoustical clutch.

2. The system as recited in claim 1, wherein the shock mitigation system further comprises an axial shock mitigator.

3. The system as recited in claim 2, wherein the shock mitigation system further comprises a radial shock mitigator.

4. The system as recited in claim 3, wherein the acoustical communication system comprises an acoustical rod member and the acoustical clutch comprises a saddle which is spring biased against the acoustical rod member.

5. The system as recited in claim 4, wherein the saddle is spring biased via a Belleville washer.

6. The system as recited in claim 4, wherein the saddle is spring biased via a plurality of Belleville washers.

7. The system as recited in claim 4, wherein the saddle is spring biased via a clamp.

8. The system as recited in claim 4, wherein at least one of the axial shock mitigator or radial shock mitigator comprises an elastomeric shock absorber.

9. The system as recited in claim 4, wherein at least one of the axial shock mitigator or radial shock mitigator comprises a hydraulic shock absorber.

10. A method, comprising:

coupling a perforating gun assembly into a tool string;

providing the tool string with a communication system for transmitting telemetry signals along the tool string, wherein the communication system is in the form of an acoustical communication system having an acoustical rod member used to carry acoustic signals; and protecting the communication system against shock loads via a shock mitigation system operatively coupled with the communication system.

11. The method as recited in claim 10, wherein protecting comprises biasing an acoustical clutch, of the shock mitigation system, against the acoustical rod member.

12. The method as recited in claim 11, wherein protecting comprises employing an axial shock mitigator, of the shock mitigation system, against the acoustical rod member.

13. The method as recited in claim 11, wherein protecting comprises employing a radial shock mitigator, of the shock mitigation system, against the acoustical rod member.

14. The method as recited in claim 11, wherein employing the acoustical clutch comprises spring biasing a saddle against acoustical rod member.

15. A system, comprising:

a subterranean communication system susceptible to shock loads; and a shock mitigation system physically coupled to the subterranean communication system, the shock mitigation system comprising a clutch which enables movement of at least a component of the subterranean communication system when subjected to a sufficient shock load, the shock mitigation system further comprising an axial shock mitigator and a lateral shock mitigator.

16. The system as recited in claim 15, wherein the subterranean communication system and the shock mitigation system are coupled into a tool string located in a wellbore.

17. The system as recited in claim 16, further comprising a perforating gun assembly coupled into the tool string.

18. The system as recited in claim 17, wherein the subterranean communication system comprises an acoustical communication system.

* * * * *